US005351174A

United States Patent [19]

Ewing

[11] Patent Number: 5,351,174

[45] Date of Patent: Sep. 27, 1994

[54] MODULAR LUMINAIRE ASSEMBLY

[75] Inventor: Robert L. Ewing, Newark, Ohio

[73] Assignee: Holophane Lighting, Inc., Newark, Ohio

[21] Appl. No.: 115,985

[22] Filed: Sep. 2, 1993

Related U.S. Application Data

[63] Continuation-in-part of Ser. No. 954,326, Sep. 30, 1992, Pat. No. 5,243,508.

[51] Int. Cl.[5] ..... H01R 33/00

[52] U.S. Cl. ..... 362/226; 362/260; 362/263; 362/265

[58] Field of Search ..... 362/43.1, 226, 802, 362/260, 263, 265

[56] References Cited

U.S. PATENT DOCUMENTS

| | | | |
|---|---|---|---|
| 3,071,683 | 1/1963 | Queale | 240/25 |
| 3,297,864 | 1/1967 | Waldbauer | 240/25 |
| 4,937,718 | 6/1990 | Murray | 362/431 |
| 5,189,339 | 2/1993 | Peshak | 362/260 |
| 5,243,508 | 9/1993 | Ewing et al. | 362/431 |

*Primary Examiner*—Carroll B. Dority
*Attorney, Agent, or Firm*—Brooks & Kushman

[57] ABSTRACT

A modular luminaire assembly including a top mounting assembly, an optical assembly removably affixable to the top mounting assembly and an electrical assembly removable affixable to the optical assembly where the optical assembly is mechanically coupled to the top mounting assembly by a quick disconnect.

16 Claims, 2 Drawing Sheets

MODULAR LUMINAIRE ASSEMBLY

CROSS-REFERENCE TO RELATED APPLICATION

This application is a continuation-in-part of U.S. patent application Ser. No. 954,326, filed Sep. 30, 1992, which issued as U.S. Pat. No. 5,243,508 on Sep. 7, 1993.

TECHNICAL FIELD

This invention relates generally to ornamental modular street or walkway luminaires. More particularly, this invention relates to a mechanical design which provides for the interchange of different optical assemblies and different electrical assemblies as modular units affixable to a mounting assembly which is itself interchangeable with similar units. The design further provides for simple disassembly for repair and replacement purposes.

BACKGROUND ART

Luminaire assembly designs of the prior art include a housing for enclosing and protecting electrical components required for operation of the luminaire, and an optical assembly. The optical assembly is generally comprised of a lighting unit and a refractor for producing and directing light of various intensities. These prior art designs often utilize electrical assemblies that are wired directly to the lighting unit through the use of a plurality of wires, splicing means, and/or permanent connecting means.

Direct wired electrical assemblies of the type referenced above have heretofore been used to ensure proper electrical contact between system components. Those skilled in the art will recognize, however, that such prior art designs have resulted in increased installation and maintenance costs because of the minimal flexibility afforded by the mechanical design. For example, it is known by those skilled in the art that particular system components of the luminaire assemblies of the type referenced herein often require repair, replacement and adjustment. In high pressure sodium systems, for example, starters, ballasts and capacitors are known to require routine maintenance. Similarly, the wattage and/or voltage characteristics of the employed lighting units often require adjustment to provide the proper amount of illumination and to conserve energy. These maintenance procedures often include the disassembly of sometimes heavy and awkward parts as well as the removal, splicing and reconnection of electrical wires. Because of the direct wired design of the prior art systems, these maintenance procedures must also be performed on-site or, in the alternative, the luminaire must be temporarily disabled while the particular component is repaired in the laboratory or factory.

The optical units of the prior art luminaire assemblies are also known to those skilled in the art to require routine repair, replacement and maintenance. For example, it is known that refractors and lighting units often must be replaced when the surfaces are penetrated by foreign substances or, when they have been fractured as a result of weather conditions or tampering. These time-consuming and labor intensive maintenance procedures must again be performed on-site and on a regular basis.

It is appreciated by those skilled in the art that the maintenance procedures referenced above are, of course, further hindered during adverse weather conditions, including heavy winds, rain and snow as well as extreme temperature gradients. The maintenance complications inherent in the prior art luminaire assembly designs have resulted in increased labor and maintenance costs which, in turn, have caused purchasers and luminaire designers to turn their attention toward viable design alternatives.

In addition to hindering repair and replacement of components, luminaire assemblies of the prior art suffer from a lack of flexibility in design. These designs make insufficient use of subassemblies, though it is well known that flexibility increases with proper employment of subassemblies. For example, instead of individually mounting small components such as starters, ballasts and capacitors to a lighting unit, it may be possible to instead attach them to a base or platform. This platform would comprise a subassembly which is then mounted to the lighting unit. Modified or new electrical components may then be incorporated into the platform. The platform can be modified to accept the new component inexpensively and quickly without affecting any other part of the luminaire. Creation of the most efficient number and type of subassemblies is an important object of current designers.

U.S. Pat. Nos. 3,297,864 and 3,071,683 issued to Waldbauer and Queale, respectively disclose prior art luminaire designs of the type referenced above. The Waldbauer patent for example, discloses a luminaire having a lighting unit, a refractor, and an electrical assembly mounted on a pivoting door. The system components of the Waldbauer luminaire are directly wired to the lighting unit.

Similarly, the Queale patent discloses a luminaire having a lighting unit, a refractor, and an electrical assembly wherein the luminaire is pivotably affixed to the luminaire housing at one end. Again, the electrical components are directly wired to the lighting unit and thus require maintenance on-site.

DISCLOSURE OF THE INVENTION

It is an object of the present invention to provided a modular luminaire assembly including a unitary optical assembly, a unitary mounting assembly and an electrical assembly, all of which are interchangeably connectable.

It is a further object of the present invention to provide a modular luminaire assembly wherein the system components may be readily repaired, replaced and adjusted on-site.

It is another object of the present invention to provide a modular luminaire assembly wherein design modifications may be efficiently and economically incorporated.

In carrying out the above objects and other objects, the modular luminaire assembly of the present invention comprises a mounting assembly having a terminal block affixed thereto and a quick disconnect provided in electrical communication with the terminal block. There is further provided an optical assembly removably affixable to the mounting assembly. Still further, there is provided an electrical assembly removably affixable to the optical assembly and electrically coupled to the mounting assembly by a mated quick disconnect. The optical assembly, mounting assembly and electrical assembly form respective first, second and third unitary modules.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
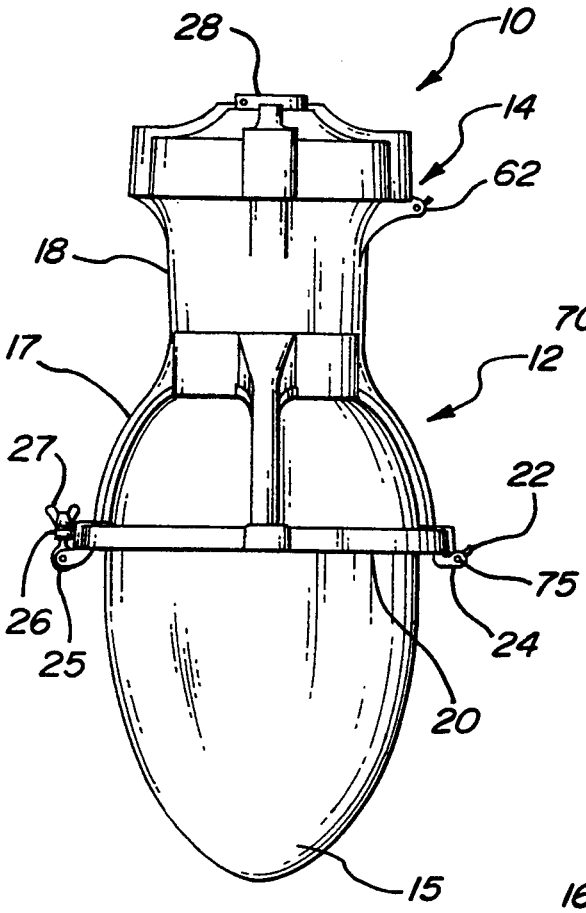
FIG. 1 is a side elevational view of the modular luminaire assembly of the present invention.
Figure 2:
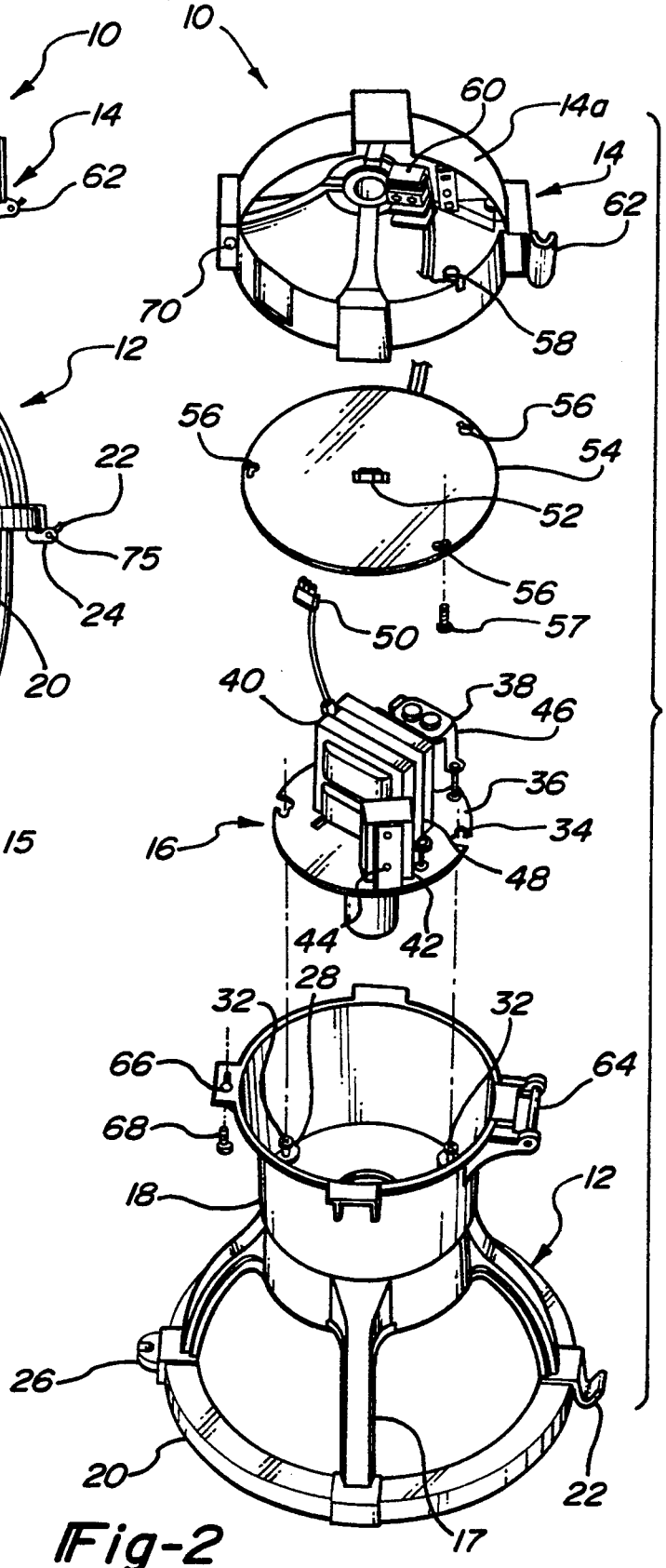
FIG. 2 is an exploded perspective view of the modular luminaire assembly of the present invention.

With reference to FIGS. 1 and 2 of the drawings, the modular luminaire assembly of the present invention is shown designated generally by reference numeral 10. The modular luminaire assembly 10 is comprised of an optical assembly 12, a top mounting assembly 14 including a cover portion 14A, a removable electrical assembly 16, and an access cover plate 54. Significantly, FIGS. 1 and 2 show one preferred embodiment of the present invention wherein an optical assembly having a tear-drop shaped prismatic glass refractor 15 is utilized.

Figure 4:
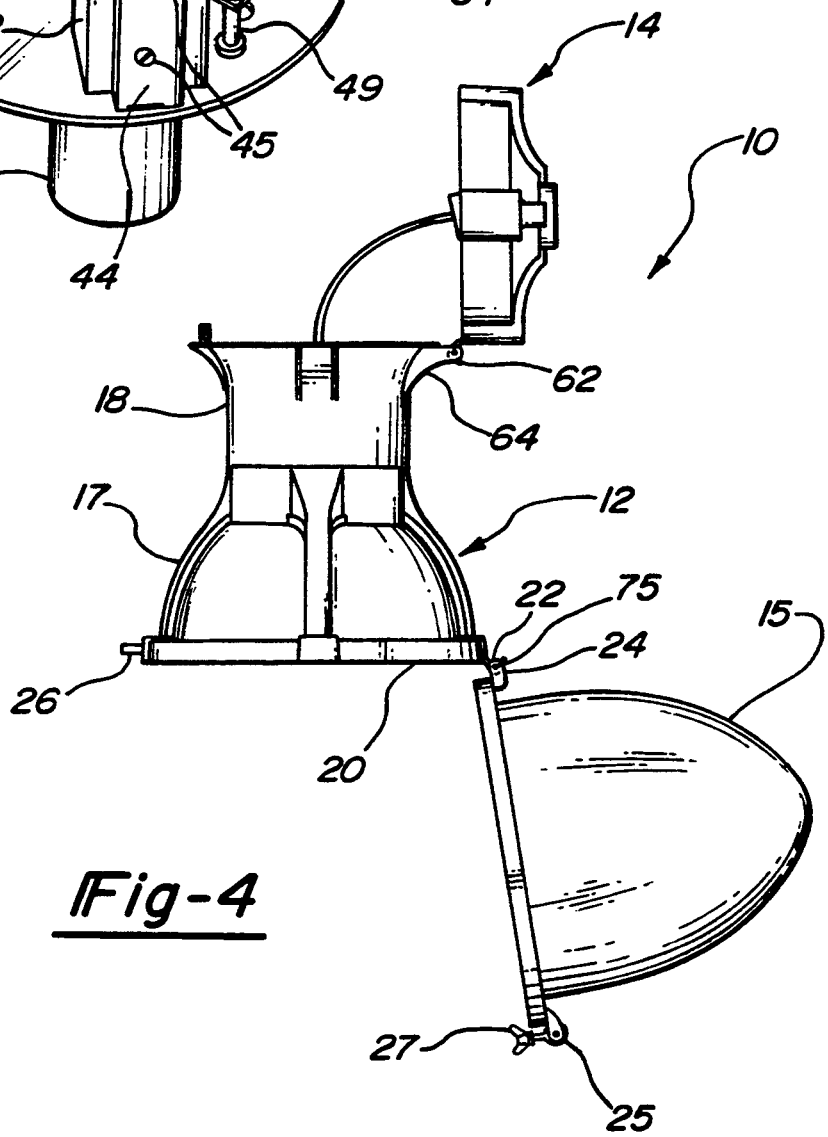
FIG. 4 is a side elevational view of the modular luminaire of the present invention shown in an open repair position.

Optical assembly 12 generally contains a cast aluminum reflector housing 17 (reflector not shown), a cast aluminum ballast housing 18, a refractor door frame 20 and a glass refractor 15. Beginning with those components located near the bottom of the luminaire assembly, glass refractor 15 is removably and pivotably affixable to door frame 20 in the following manner. Glass refractor 15 contains an extending mounting bracket 24 including a mounting pin designed to rest on v-shaped door hinge 22. Once mounting pin 25 and hinge 22 are cooperatively engaged, glass retractor 25 is pivotable from a fully closed position to an open position, as shown in FIGS. 1 and 4. A latch pin 25 is provided to connect with a slotted refractor door latch 26. A wing nut 27 secures latch pin 25 to refractor door latch 26 to secure glass retractor 25 in the closed position. Not shown in the drawings are reflector means which are located within housing 17.

Moving up the assembly, ballast housing 18 is adapted to receive electrical assembly 16. Ballast housing 18 contains a pair of threaded holes 28 for receiving common screws 32. Electrical assembly 16 fits inside ballast housing 18 and is connectable thereto by cooperation of slots 34 with screws 32. As shown, slots 34 are provided on the periphery of a substantially flat and horizontally disposed mounting plate 36. The wide portions 72 of slots 34 are configured to accept the heads of screws 32. Once mounting plate 36 is seated inside housing 18 the electrical assembly 16 is rotated clockwise to engage the narrower portions 73 of slots 34. Screws 32 are then tightened to secure mounting plate 36 to housing 18.

Figure 3:
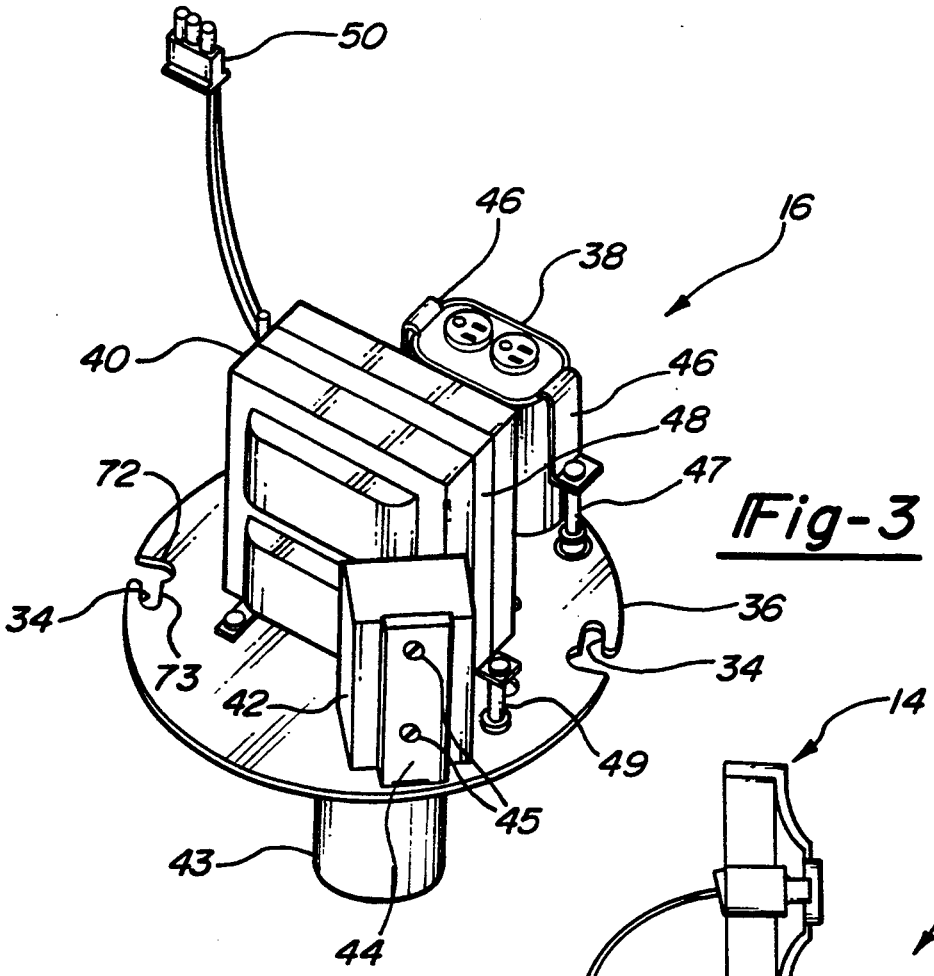
FIG. 3 is a top perspective view of a modular electrical assembly provisioned for use in the present invention.

Referring now to FIG. 3, plate 36 is adapted to receive and retain various electrical components such as a capacitor 38, a ballast 40 and a starter 42. In the preferred embodiment shown in FIG. 3, capacitor 38 is removably affixable to mounting plate 36 through the use of a pair of mounting brackets 46. Tension in brackets 46 is maintained by a pair of elastic members 47. Ballast 40 is affixed to mounting plate 36 through the use of a mounting strap 48. Again, tension is maintained by a pair of elastic members 49. Starter 42 is affixable to mounting plate 36 by a bracket 44 and a pair of screws 45 As readily seen, each of these electrical components, i.e. starter 42, capacitor 38 and ballast 40 have corresponding electrical connections which terminate in a male quick disconnect 50.

Referring again to FIGS. 1 and 2, it is seen that an access cover plate 54 is further provided which is removably affixable to top mounting assembly 14. Top mounting assembly 14 includes three threaded holes 58 for receiving screws 57. Three slotted key-holes 56 are disposed on cover plate 54 and cooperate with screws 57 to affix plate 54 to top mounting assembly 14. Cover plate 54 is attachable to top mounting assembly 14 and serves, in combination with top mounting assembly 14, as a barrier for protecting the electrical components from environmental effects.

Electrical assembly 16, cover plate 54 and top mounting assembly 14 are maintained in electrical communication. As shown, male quick disconnect 50 is engagable with female quick disconnect 52 provided in cover plate 54. In turn, female quick disconnect 52 is electrically connected to terminal block 60 provisioned in top mounting assembly 14. Electrical assembly 16 contains a socket 43 adapted to receive illumination means (not shown).

Finally, top mounting assembly 14 is removably and pivotably attached to optical assembly 12 and electrical assembly 16 in the following manner. Top mounting assembly 14 contains a ballast hinge 62 which is adapted to receive hinge pin 64 affixed to ballast housing 18. Opposite ballast hinge 62 is threaded hole 70 provisioned in top mounting assembly 14. Threaded hole 70 is aligned with hole 66 provided in optical assembly 12. Retaining screw 68 extends through hole 66 and cooperates with threaded hole 70 to secure mounting assembly 14 to housing 18.

As referenced above, optical assembly 12, top mounting assembly 14 and electrical assembly 16 form first, second and third unitary modules. Thus, to achieve desired aesthetic appearances and/or different light distribution, various unitary modules having similar connecting characteristics but different electrical, mechanical and luminating qualities may be substituted. For example, a tear-drop shaped prismatic glass refractor 15 is shown for use with optical assembly 12 in FIG. 1. If desired, a plurality of different refractors adapted to be received by refractor door frame 20 may be utilized. Similarly, a plurality of selected top mounting assemblies may also be used for varying aesthetic appearance so long as they contain the required electrical and mechanical components of top mounting assembly 14. As a final example, various electrical characteristics may be achieved by the substitution of the components of the electrical assembly 16 such as the capacitor 38.

In addition to interchangeability, the design of the luminaire of the present invention facilitates simple repair and replacement of component parts. With reference to FIGS. 1 and 4 it is readily seen that the optical assembly 12 may be opened by removing wing nut 27 and rotating refractor 15 from a closed operating position as shown in FIG. 1 to an open repair position as shown in FIG. 4. The open position facilitates the replacement of illumination means and reflector means (not shown). Significantly, glass refractor 15, which is of considerable weight, is retained during maintenance by the connection of mounting pin 24 and hinge 22. Optical assembly 12 may then be closed by reversing the above steps and normal operation of the unit may resume.

With reference to FIGS. 1, 2 and 4 it is readily seen that electrical assembly 16 can be accessed by removing retaining screw 68 and pivoting top mounting assembly 14 from a closed operating position as shown in FIG. 1 to an open repair position as shown in FIG. 4. Quick disconnects 50 and 52 may be readily disconnected to disengage electrical assembly 16 from cover 54. After screws 32 are loosened, electrical assembly 16 is then rotated counterclockwise and removed for repair or replacement. A new or repaired electrical assembly may thereafter be positioned in place by following the same steps in reverse order.

As those skilled in the art will recognize, the luminaire components which generally require replacement, repair or adjustment are those found in electrical assembly 16 and include, for example, capacitor 38, ballast 40 and starter 42. In accordance with the present invention, these components may be readily accessed and replaced on site. More preferably, in the event of a malfunction, a service technician may easily replace the entire electrical assembly on-site and examine the malfunctioning electrical assembly off-site where testing equipment is readily available and trained technicians may be consulted. In this manner, the loss of service by the luminaire in question will be minimized and on-site servicing will be reduced.

It is appreciated that the modular design of the present invention results in reduced service and maintenance time because no hard wiring or splicing is required. Those skilled in the art will recognize and appreciate that this reduction in service time is particularly important in high pressure sodium system where starters are known to require routine maintenance even if operated under normal operating and weather conditions. It is further appreciated that the particular modular design of the present invention which provides for the retaining of optical assembly 12 in the open and closed positions via hinge 22 and pin 75 further reduces the number of service personnel required and thus minimizes the expense incurred in servicing luminaires of the type described herein.

While the invention has been particularly shown and described in reference to the preferred embodiment thereof, it will be understood by those skilled in the art that various changes in form and details may be made therein without departing from the spirit and scope of the invention.

What is claimed is:

1. A modular luminaire assembly comprising:

a top mounting assembly;

an optical assembly removably affixable to said top mounting assembly; and an electrical assembly including a lamp socket removably affixable to said optical assembly and mechanically coupled to said top mounting assembly by a quick disconnect wherein said electrical assembly is in electrical communication with said top mounting assembly.

2. A modular luminaire assembly as in claim 1, wherein said electrical assembly comprises:

a mounting plate;

a ballast; and a capacitor, the lamp socket, ballast and capacitor each affixed to said mounting plate and having electrical connections which terminate in said quick disconnect.

3. A modular luminaire as in claim 2 wherein said electrical assembly further comprises a starter having an electrical connection which terminates in said quick disconnect.

4. A modular luminaire assembly as in claim 1, wherein said top mounting assembly comprises:

a cover portion;

a terminal block affixed to said cover portion;

an access cover plate; and a mounting assembly quick disconnect in electrical contact with said terminal block and affixed to said access cover plate for mechanical coupling to said electrical assembly quick disconnect.

5. A modular luminaire assembly as in claim 4, further comprising retaining means for retaining said optical assembly to said top mounting assembly during replacement or repair of said electrical assembly.

6. A modular luminaire assembly as in claim 5, wherein said retaining means comprises a hinge pin affixed to said optical assembly and a hinge affixed to said top mounting assembly which is adapted to rotatably receive said hinge pin.

7. A modular luminaire, comprising:

a top mounting assembly;

an optical assembly having illumination means for generating light, said optical assembly selected from a plurality of approved optical assemblies and removably affixable to said top mounting assembly;

an electrical assembly including a lamp socket in electrical contact with said illumination means, said electrical assembly selected from a plurality of approved electrical assemblies; and energizing means for providing electrical energy to said electrical assembly, said energizing means mechanically coupled to said electrical assembly by quick disconnect, wherein said top mounting assembly, said optical assembly and said electrical assembly form first, second and third unitary modules.

8. A modular luminaire assembly as in claim 7, wherein said electrical assembly comprises:

a mounting plate;

a ballast; and a capacitor, the lamp socket, ballast and capacitor each affixed to said mounting plate and having electrical connections which terminate in a quick disconnect.

9. A modular luminaire assembly as in claim 8 further comprising a starter having an electrical connection which terminates in said quick disconnect.

10. A modular luminaire assembly as in claim 8, wherein said top mounting assembly comprises:

a cover portion;

a terminal block affixed to said cover portion;

an access cover plate; and a quick disconnect in electrical contact with said terminal block and affixed to said access cover plate for mechanical coupling to said electrical assembly quick disconnect.

11. A modular luminaire assembly as fin claim 7, further comprising retaining means for retaining said optical assembly to said top mounting assembly during replacement or repair of said electrical assembly.

12. A modular luminaire assembly as in claim 11, wherein said retaining means comprises a hinge pin affixed to said optical assembly and a hinge affixed to said top mounting assembly which is adapted to rotatably receive said hinge pin.

13. A modular luminaire assembly, comprising:

a top mounting assembly;

an optical assembly affixable to said top mounting assembly wherein said top mounting assembly is pivotable from a closed operating position to an open repair position; and an electrical assembly removably affixable to said optical assembly and mechanically coupled to said top mounting assembly by quick disconnect.

14. A modular luminaire assembly as in claim 13, further comprising:

a hinge pin affixed to said optical assembly; and a hinge affixed to said top mounting assembly and adapted to receive said hinge pin such that said optical assembly may be rotatably opened and supported during repair.

15. A modular luminaire assembly as in claim 14, further comprising locking means for retaining said optical assembly in said closed operating position.

16. A modular luminaire assembly as in claim 15, wherein said locking means comprises:

an aperture disposed in said optical assembly;

a threaded hole disposed in said top mounting assembly; and a captive screw adapted to be positioned through said aperture and retained in said threaded hole.

* * * * *